US007670120B2

(12) United States Patent
Ginies et al.

(10) Patent No.: US 7,670,120 B2
(45) Date of Patent: Mar. 2, 2010

(54) SCROLL-TYPE REFRIGERANT COMPRESSOR HAVING FLUID COMMUNICATION BETWEEN LUBRICATION DUCT AND RETURN DUCT

(75) Inventors: Pierre Ginies, Sathonay Village (FR); David Genevois, Cailloux sur Fontaine (FR); Jean De Bernardi, Lyons (FR)

(73) Assignee: Danfoss Commercial Compressors, Trevoux (FR)

( * ) Notice: Subject to any disclaimer, the term of this patent is extended or adjusted under 35 U.S.C. 154(b) by 109 days.

(21) Appl. No.: 11/920,979

(22) PCT Filed: May 23, 2006

(86) PCT No.: PCT/FR2006/001175

§ 371 (c)(1),
(2), (4) Date: Jan. 2, 2008

(87) PCT Pub. No.: WO2006/125908

PCT Pub. Date: Nov. 30, 2006

(65) Prior Publication Data

US 2009/0041602 A1 Feb. 12, 2009

(30) Foreign Application Priority Data

May 23, 2005 (FR) ..... 05 05153

(51) Int. Cl.
*F04C 18/02* (2006.01)
*F04C 2/00* (2006.01)

(52) U.S. Cl. ..... 418/55.6; 418/55.1; 418/94; 418/97

(58) Field of Classification Search ..... 418/55.1–55.6, 418/57, 88, 94, 97, 102, 270, DIG. 1; 417/310
See application file for complete search history.

(56) References Cited

U.S. PATENT DOCUMENTS

| | | | | |
|---|---|---|---|---|
| 4,875,840 | A | 10/1989 | Johnson et al. | |
| 5,240,389 | A * | 8/1993 | Oikawa et al. | 417/310 |
| 6,599,100 | B2 * | 7/2003 | Abe et al. | 418/55.6 |
| 2001/0026766 | A1 | 10/2001 | Terai et al. | |

FOREIGN PATENT DOCUMENTS

| | | | |
|---|---|---|---|
| EP | 0 341 408 | A2 | 11/1989 |
| JP | 2001065474 | A * | 3/2001 |

* cited by examiner

*Primary Examiner*—Theresa Trieu
(74) *Attorney, Agent, or Firm*—Oliff & Berridge PLC

(57) ABSTRACT

A scroll-type refrigerant compressor includes a drive shaft with an off-axis lubrication conduit which is supplied with oil from an oil pan located in the lower part of the compressor by an oil pump that is disposed at a first end of the shaft. The lubrication conduit has lubrication holes at the different shaft guide bearings. The second end of the shaft is equipped with a device that enables the orbital movement of the moving scroll of the compressor. The aforementioned shaft also includes a return conduit which is inclined in relation to the axis of the shaft and which extends over at least part of the length thereof. One of the ends of the return conduit opens at the wall of the shaft in the area located beyond the rotor on the side of the oil pan. In addition, fluid communication is provided between the lubrication conduit and the return conduit.

11 Claims, 4 Drawing Sheets

SCROLL-TYPE REFRIGERANT COMPRESSOR HAVING FLUID COMMUNICATION BETWEEN LUBRICATION DUCT AND RETURN DUCT

The subject of the present invention is a cooling spiral compressor.

A spiral compressor, also known as a scroll compressor, comprises a sealed enclosure delimited by a shell containing a suction volume and a compression volume separated by a compression stage, and placed respectively on the sides of the two ends of the enclosure.

An electric motor is placed in the suction volume, with a stator situated on the outside, mounted fixedly relative to the shell, and a rotor placed in a central position, fixedly attached to a drive shaft or crank shaft. The drive shaft comprises an out-of-alignment lubrication duct extending over the whole length of the latter, supplied with oil contained in a casing situated in the bottom portion of the enclosure by an oil pump placed at a first end of the shaft. The lubrication duct comprises lubrication orifices at the various guide bearings of the shaft.

The compression stage contains a fixed volute fitted with a spiral engaged in a spiral of a movable volute, the two spirals delimiting at least one compression chamber of variable volume. The second end of the drive shaft is fitted with an eccentric driving the movable volute in an orbital motion, to compress the aspirated refrigerant gas.

The shell delimiting the sealed enclosure comprises a refrigerant gas inlet. This inlet opens into the annular volume arranged between the motor and the shell. From a practical point of view, gas arrives from outside and enters this annular space. One portion of the gas is directly sucked in the direction of the compression stage, while the other portion of the gas travels through the motor before flowing in the direction of the compression stage. All the gas arriving at the compression stage either directly, or after passing through the motor, is sucked in by the compression stage, entering at least one compression chamber delimited by the two spirals, the entrance being made at the periphery of the compression stage, and the gas being carried to the center of the spirals gradually as the compression is generated by reducing the volume of the compression chambers, resulting from the movement of the movable volute relative to the fixed volute. The compressed gas leaves at the central portion in the direction of the chamber for recovering the compressed gas.

This structure has a certain number of disadvantages, and particularly because, when the oil for lubricating the various bearings close to the compression zone returns to the casing, the latter flows through the interstices arranged at the motor and therefore comes into contact with the refrigerant gas passing through the motor, which may generate an excessive proportion of oil in the refrigerant gas leaving the compressor. The direct consequence of this excessive proportion of oil in the gas is a loss of heat exchange efficiency of the exchangers situated downstream of the compressor, because the oil droplets contained in the gas tend to be deposited on the exchangers and form a film of oil on the latter.

In addition, an excessive proportion of oil in the gas may also empty the oil reservoir of the casing, which could ruin the compressor.

To remedy these disadvantages, a separation of the gas and oil flows is often used.

A known solution for separating the gas and oil flows consists in providing deflectors on the flow path of the refrigerant gas. Because of the changes of direction and the differences of speed due to the presence of the deflectors, the oil is separated from the gaseous flows and falls by gravity into the casing.

However, the effectiveness of this solution is directly linked to the speeds of the gases. Specifically, when the speeds of the gases are too high, the time for separation of the oil and gas is greatly diminished, which may cause an excessive proportion of oil in the gas and therefore a reduction in the efficiency of the compressor or even a destruction of the latter.

Therefore, this solution for separating the gas and oil flows is not sufficiently effective and reliable in all the application conditions of the compressor.

Another problem encountered in this type of compressor is linked to the degassing of the refrigerant gas contained in the lubrication oil when the latter flows in the lubrication duct. This degassing of the gas in the lubrication duct is a consequence of the centrifugation generated by the rotation of the drive shaft.

In certain conditions of operation of the compressor, the degassing of the refrigerant gas limits the flow of oil supply to the bearings, which may cause a risk of damage to the compressor.

In order to prevent this situation, various solutions for carrying these gases away are proposed.

A known solution consists in arranging radial vent holes in the drive shaft at the various bearings, these vent holes opening on the one hand into the lubrication duct and on the other hand into the wall of the shaft opposite the lubrication orifices. This solution involves arranging, by construction, a pressure gradient helping to expel the gas from the lubrication duct through the vent holes, the pressure gradient however being limited so as not to disrupt the oil flow in the duct. Specifically, too high a pressure gradient could expel oil through the vent holes.

The conditions of use of the compressor over its application range involve pressure gradients at the boundaries of the vent holes that vary in large proportions and that therefore greatly change the effectiveness of degassing of the vent holes. In addition, in some cases, the pressure gradient may be inverted and create a vacuum in the lubrication duct, which prevents an expulsion of the gas through the vent holes, which reduces or limits the oil flow leaving the pump on its way to the bearings.

The object of the present invention is therefore to remedy these disadvantages.

The technical problem at the basis of the invention is the production of a cooling spiral compressor making it possible to control the proportion of oil in the gas leaving the compressor in all the operating conditions of the compressor, while ensuring an effective lubrication of the various guide bearings of the drive shaft.

Accordingly, the present invention relates to a cooling spiral compressor comprising:

- a sealed enclosure containing a suction volume and a compression volume placed respectively on the side of the two ends of the enclosure on either side of a body, the enclosure comprising a refrigerant gas inlet,
- an electric motor placed on the suction side having a stator and a rotor fixedly attached to a drive shaft in the form of a crankshaft,
- the drive shaft comprising an out-of-alignment lubrication duct extending over the whole length of the latter, supplied by oil contained in a casing situated in the bottom portion of the enclosure by an oil pump placed at a first end of the shaft, the lubrication duct comprising lubrication orifices at different guide bearings of the shaft, the second end of the drive shaft being fitted with a device for driving the movable spiral of the compressor in an orbital motion, characterized in that the drive shaft comprises a return duct parallel or inclined relative to the axis of the shaft and extending over at least a portion of the length of the shaft, one of the ends of the return duct opening into the wall of the shaft, in the zone of the latter situated beyond the rotor, on the side of the oil casing, means being provided for placing the lubrication and return ducts in fluidic communication.

The lubrication duct allows oil to travel from the oil casing to the compression stage in order to lubricate the various guide bearings of the shaft. After all the bearings have been supplied with oil, if there is residual oil, the latter can be carried away in the return duct thanks to the means for placing in communication. Because of the rotation of the shaft, the oil pressed by centrifugation onto the outer portion is forced to flow in the direction of the casing. This residual oil is carried directly to the oil casing without passing through the motor, which therefore makes it possible to limit its contact with the refrigerant gas.

Accordingly, the structure of the compressor according to the invention makes it possible to provide a separation of the oil and gas flows that is not linked to the speeds of the gas and hence to the operating conditions of the compressor. Therefore, the structure of the compressor makes it possible to control the proportion of oil in the gas leaving the compressor in all the operating conditions of the latter.

In addition, the means for placing in communication allow the gas originating from the degassing of the lubrication duct to travel in the return duct to its bottom end irrespective of the flow and speed of rotation of the shaft and the speed of the gases traveling in the compressor. Therefore, the gases originating from the degassing are effectively carried away in all the operating conditions of the compressor.

In addition, because the residual oil is pressed by centrifugation in the outer portion of the return duct, the latter leaves a free passage for the gas to the bottom end of the return duct. This free passage makes it possible to carry away the gas originating from the degassing in excellent conditions even if there is surplus oil for supplying the bearings.

Advantageously, the second end of the return duct opens at the end of the shaft situated on the side of the movable spiral, the means for placing in fluidic communication comprising a space delimited by the end of the shaft situated on the side of the movable spiral and the bottom of a housing receiving this end of the shaft.

According to another feature of the invention, the means for placing in fluidic communication comprise at least one transverse orifice arranged in the shaft whose two ends open respectively into the lubrication and return ducts.

Advantageously, the transverse orifice extends radially relative to the shaft.

According to yet another feature of the invention, the end of the return duct opening at the end of the shaft situated on the side of the movable spiral opens close to the center of the shaft.

Advantageously, the end of the return duct opening, on the side of the casing, into the wall of the shaft is situated substantially at the second end of the shaft.

According to another feature of the invention, the end of the return duct opening on the side of the casing comprises a vacuum pump designed to accelerate the flow of fluid in the return duct.

Preferably, the diameter of the return duct is less than or equal to the diameter of the lubrication duct.

According to another feature of the invention, the lubrication duct is inclined relative to the axis of the shaft.

According to yet another feature of the invention, the body of the compressor forms an oil collector designed to collect the leakage flows from the bearings situated on the side of the movable spiral, recirculation means being provided to move the oil collected by the collector in the return duct.

Advantageously, the recirculation means comprise a duct arranged in the drive shaft opening on the one hand into the return duct and on the other hand into an annular groove arranged in the shaft or in the body of the compressor, a duct supplied with oil from the collector by an oil pump opening into the annular groove.

In any case, the invention will be well understood with the aid of the following description, with reference to the appended schematic drawing, representing, as nonlimiting examples, several embodiments of this compressor.

Figure 1:
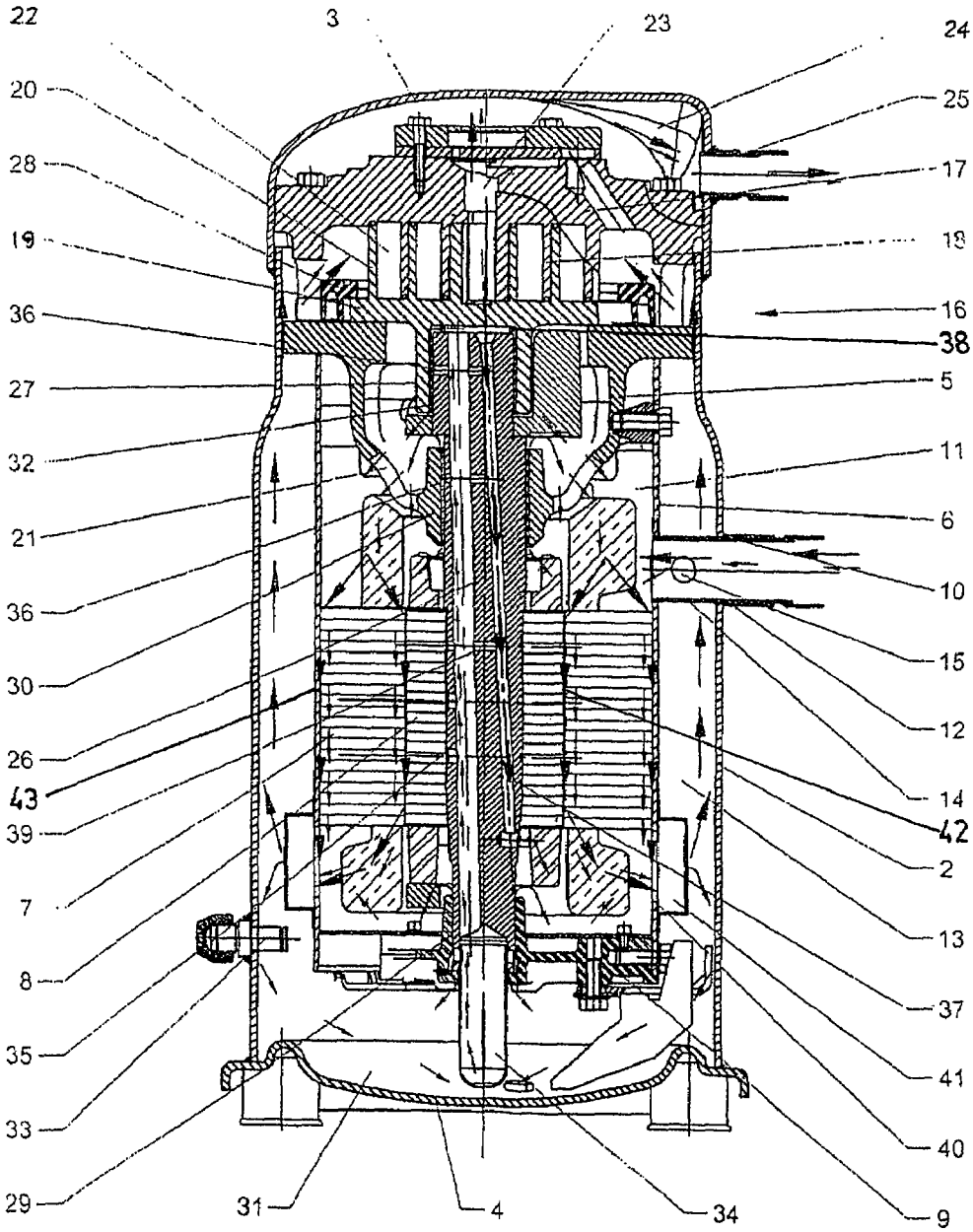
FIG. 1 is a view in longitudinal section of a first compressor.

FIG. 1 describes a cooling spiral compressor occupying a vertical position. However, the compressor according to the invention, could occupy an inclined position, or a horizontal position, without its structure being modified.

The compressor shown in FIG. 1 comprises a sealed enclosure delimited by a shell 2 whose top and bottom ends are closed respectively by a cover 3 and a base 4. The intermediate portion of the compressor is occupied by a body 5 that delimits two volumes, a suction volume situated below the body 5 and a compression volume placed above the latter. Onto the body a tube 6 is attached inside which an electric motor is mounted comprising a stator 7 in the center of which a rotor 8 is placed. The tube 6 is for example swaged onto the stator so as to support the motor. At its bottom end, the tube 6 rests on a centering part 9 itself attached to the shell 2. In the shell 2 an orifice 10 is arranged with which is associated a coupling 12 for bringing gas to the compressor. This coupling 12 opens into an annular volume 13 arranged between the shell 2 and the tube 6 containing the motor, in the top portion of the motor.

The coupling 12 is extended, at the annular volume 13, by a sleeve 14 passing through this annular space and opening into a top chamber 11 delimited by the tube 6, containing the coil head of the motor. In the annular volume 13, the sleeve 14 has a bypass opening 15.

The body 5 is used for mounting a gas compression stage 16. This compression stage comprises a fixed volute 17 fitted with a fixed spiral 18 turned downward, and a movable volute 19 fitted with a spiral 20 turned upward. The two spirals 18 and 20 of the two volutes penetrate one another to arrange variable volume compression chambers 22. The gas is admitted from the outside, the compression chambers 22 having a variable volume that diminishes from the outside to the inside during the movement of the movable volute 19 relative to the fixed volute 17, the compressed gas escaping at the center of the volutes via an opening 23 in the direction of a chamber 24 from which it is carried away via a coupling 25.

Onto the rotor 8 a shaft 26 is immobilized whose top end is out of alignment in the manner of a crankshaft. This top portion is engaged in a housing delimited by a portion 27 in the shape of a sleeve, that the movable volute 19 comprises. When it is rotated by the motor, the shaft 26 drives the movable volute that is guided by means of a connecting element 28 in relation to the fixed volute 17, in an orbital motion.

The shaft 26 is guided relative to the other parts by means of a bottom bearing 29 arranged in the centering part 9, an intermediate bearing 30 arranged in the body 5 and a top bearing 32 arranged between the shaft 26 and the sleeve 27. The volume containing the top bearing 32 communicates with the chamber 11 through openings 21 arranged in the body 5.

The base 4 delimits a casing 31 containing oil, the oil level being marked by the reference 33. Immersed in the oil bath is the end of the inlet duct of the pump 34, which supplies the various bearings with lubrication oil by means of a lubrication duct 35 inclined relative to the axis of the shaft, opening into the end of the latter situated on the side of the movable volute 19, and by lubrication orifices 36 at the bearings, to lubricate the latter.

In the top portion, the lubricating oil may return to the casing by passing through the openings 21 arranged in the body 5, and in the interstices arranged at the motor, allowing the leakage flow from the bearings 30, 32 and from the movable volute 19 to flow in the direction of the motor.

In FIG. 1, the thick arrows represent the gas flow and the thin arrows represent the oil flow.

According to an important feature of the invention, the shaft 26 also comprises a return duct 37 for the oil, inclined relative to the axis of the shaft, of which one end opens at the end of the shaft turned toward the movable volute 19 and at the center of the shaft, and of which the other end opens into the peripheral wall of the shaft, in the zone of the latter situated at the end of the motor opposite to the compression volume.

Means are provided for placing the lubrication duct 35 and the return duct 37 in fluidic communication. These means for placing in communication comprise a space 38 delimited by the end of the shaft situated on the side of the movable spiral and the bottom of the housing receiving this end of the shaft.

The means for placing in fluidic communication also comprise transverse orifices 39 arranged in the shaft, the two ends of each orifice opening respectively into the lubrication duct 35 and return duct 37.

The tube 6 used to support the motor comprises, in its bottom portion, one or more radial orifices 40 that can each be fitted with a diffuser such as a grill 41.

The operation of this compressor is as follows: refrigerant gas impregnated with oil and potentially with liquid particles arrives via the coupling 12. An important portion of the gas flow passes via the sleeve 14 into the volume delimited by the tube 6 that is above the motor. Another portion of the flow passes the bypass duct 15 into the annular volume 13 to flow directly toward the compression stage 16. The gas arriving in the volume situated above the motor is mixed with the lubrication oil that flows in the direction of the bottom bearing 29, particularly from the top bearing 32 and the intermediate bearing 30. The mixture of gas and lubrication oil travels through the motor to the bottom, carrying away the heat losses of the motor. This passage occurs in particular through a space 42 situated between the rotor and the stator, and via a space 43 situated between the stator and the tube 6. The mixed flow flowing through the motor arrives in the bottom portion of the motor where the oil flow from the bottom bearing is added. The gas-oil mixture then passes through the radial orifices 40 through the diffusers 41 consisting for example of a metal trellis forming a grill. This trellis allows the gas flow to diffuse all around the motor tube, in the annular volume 13. Because of the changes of direction and the differences of speed, the oil is separated from the gaseous flow and falls into the casing 31. The gaseous flow then travels via the annular volume 13 to the compression stage 16. Separation of the gas and the oil continues during the journey into the annular volume because of gravity and/or the controlled gas speeds and an appropriate separation time.

The lubrication duct 35 allows oil to travel from the oil casing 31 to the compression stage in order to lubricate the various guide bearings of the shaft. After supplying all the bearings with oil, the residual oil is carried away in the return duct 37 by means of the space 38. Because of the rotation of the shaft 26, the oil pressed by centrifugation onto the outer portion of the return duct is forced to flow in the direction of the casing. This residual oil is carried directly to the oil casing without passing through the motor, which therefore makes it possible to limit its contact with the refrigerant gas.

In addition, the transverse orifices 39 allow gas originating from the degassing to pass into the return duct 37 to its bottom end irrespective of the flow and speed of rotation of the shaft and the speed of the gases traveling in the compressor. The gas in the return duct can be made to flow because of the fact that the oil pressed by centrifugation leaves free passage to the gas from the bearing of the movable volute to the other end of the return duct. This free passage makes it possible to carry away the gas originating from the degassing of the various bearings in excellent conditions even if there is surplus oil for the supply of the bearings.

Figure 2:
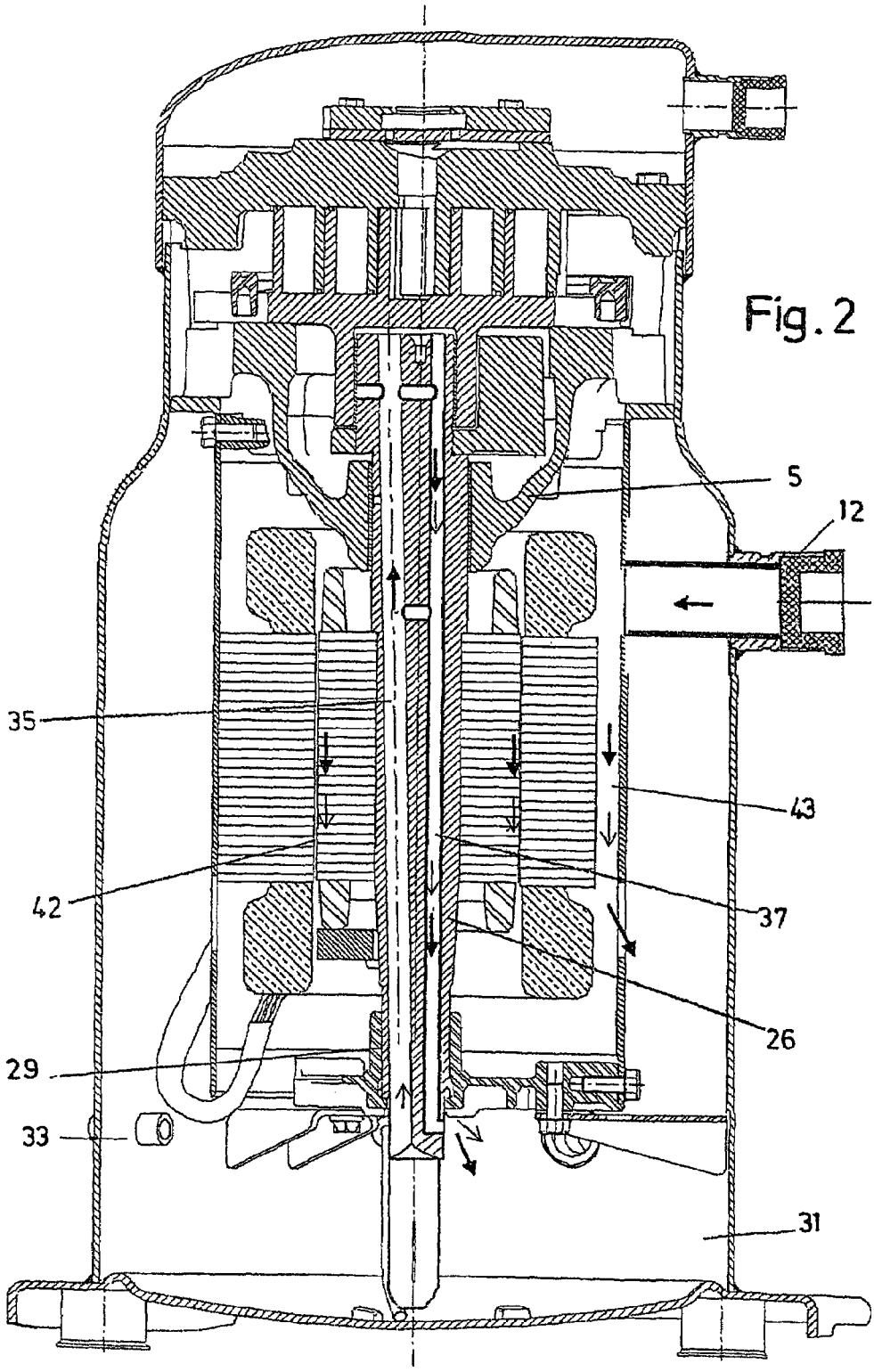
FIG. 2 is a view in longitudinal section of a second compressor.

FIG. 2 represents a variant embodiment of the compressor of FIG. 1 in which the same elements are indicated by the same reference numbers as before. In this compressor, the end of the return duct 37 opening, on the side of the casing 31, into the wall of the shaft 26 is situated substantially at the second end of the shaft and beyond the bottom bearing 29.

In this case, the return duct 37 makes it possible to carry away a considerable flow of oil, while being sure that the latter will return to the casing, irrespective of the flow provided by the pump and the speed of rotation of the shaft.

Figure 3:
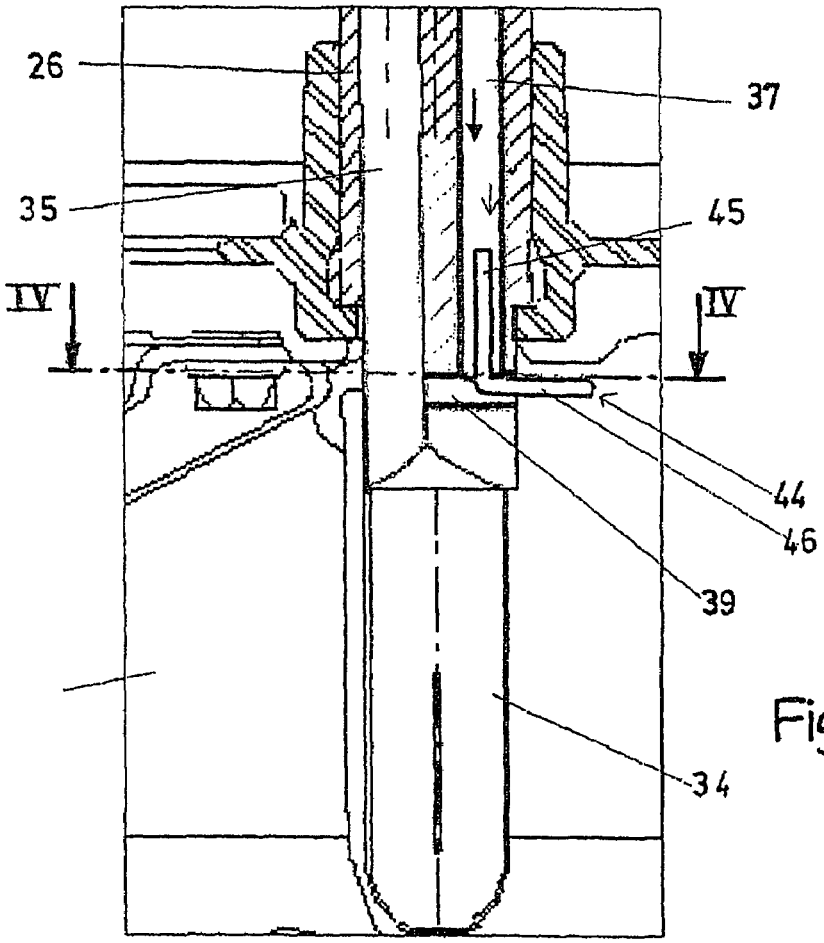
FIG. 3 is a partial enlarged view in cross section of a third compressor.
Figure 4:
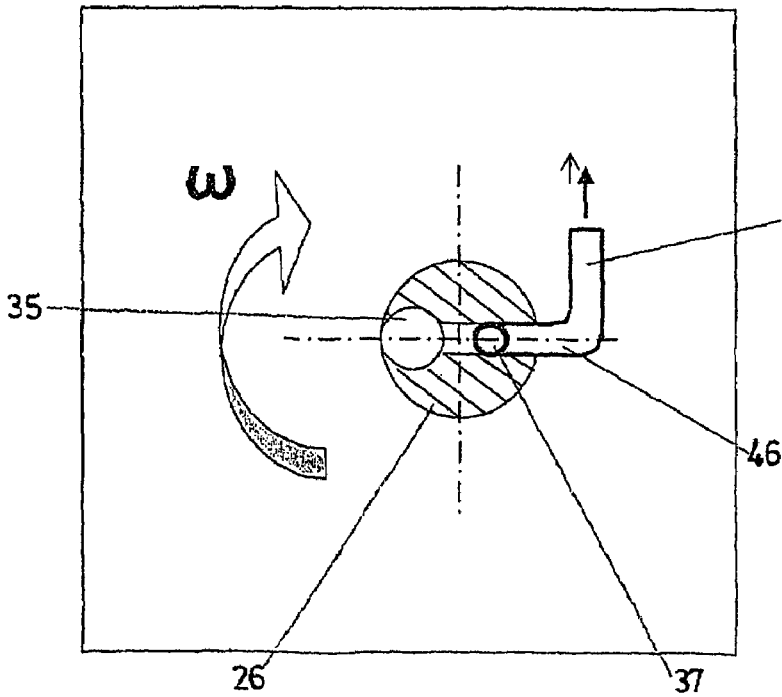
FIG. 4 is a partial view in section along the line IV-IV of FIG. 3.

FIGS. 3 and 4 represent a variant embodiment of the compressor of FIG. 2. In this compressor, the end of the return duct 37 situated on the side of the casing 31 opens into a transverse orifice 39 arranged in the shaft whose two ends open respectively into the lubrication duct 35 and the wall of the shaft.

In addition, this end of the return duct 37 is fitted with a vacuum pump 44 designed to accelerate the flow of fluid in the return duct. The vacuum pump is formed by a tube comprising a first portion 45 placed longitudinally in the return duct, a second portion 46 perpendicular to the first portion and extending in the transverse orifice 39 radially outward from the first portion, and a third portion 47 perpendicular to the plane defined by the first and second portions and extending from the second portion in a direction opposite to the direction of rotation of the shaft.

It should be noted that the first and second portions have sections that are respectively less than those of the return duct and of the transverse orifice 39, in order to allow free passage to a certain quantity of fluid flowing in the return duct and in the transverse orifice.

During the rotation of the shaft 26, whose direction of rotation is shown by the arrow ω in FIG. 4, the structure of this tube creates a vacuum in the return duct and therefore a suction effect in the latter. The result of this is an acceleration of the fluid that is close to the opening of the tube placed in the return duct, and therefore, step by step the flow of the fluid traveling in the return duct.

The presence of this vacuum pump therefore helps with the return of oil to the casing.

Figure 5:
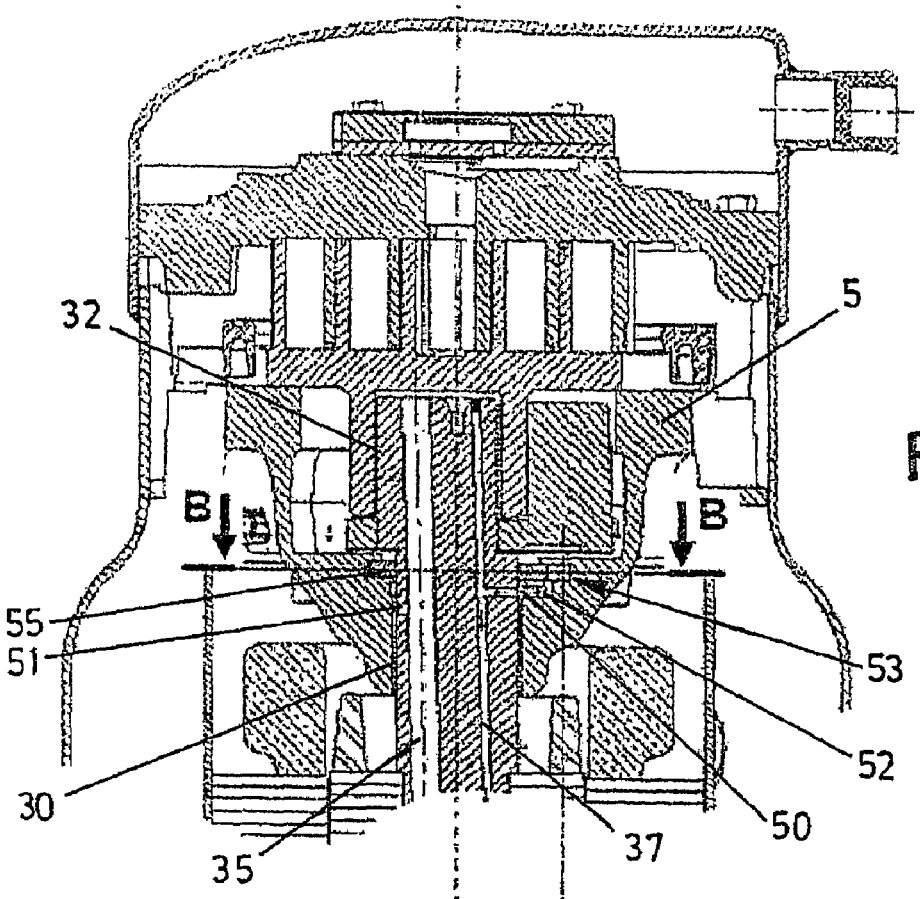
FIG. 5 is a partial view in longitudinal section of a fourth compressor.
Figure 6:
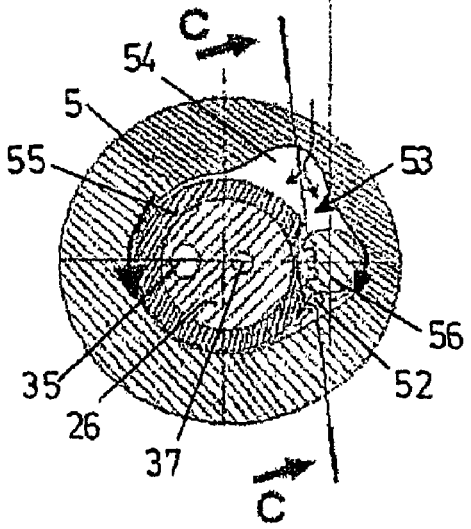
FIG. 6 is a view in section along the line B-B of FIG. 5.
Figure 7:
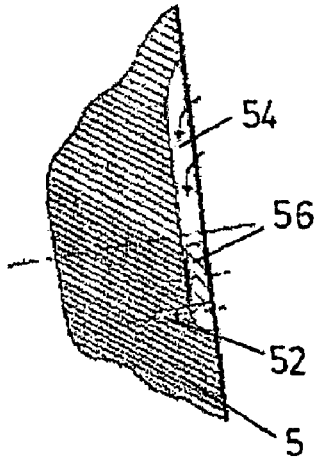
FIG. 7 is a view in section along the line C-C of FIG. 6.

FIGS. 5 to 7 represent a fourth variant embodiment of the compressor of FIG. 1.

According to this variant embodiment, the body 5 of the compressor contains no openings 21 and therefore forms an oil collector designed to collect the leakage flows from the top bearing 32 and intermediate bearing 30.

Recirculation means are provided to carry the oil collected by the collector into the return duct 37. The recirculation means comprise a duct 50 arranged in the drive shaft 26 and opening on the one hand into the return duct 37 and on the other hand into an annular groove 51 arranged in the body 5 of the compressor. The recirculation means also comprise a duct 52 arranged in the body 5 and opening into the annular groove 51. The duct 52 is supplied with oil from the collector by an oil pump 53 placed in a housing 54 arranged in the body 5.

The oil pump 53 comprises a first gear wheel 55 placed about the shaft 26 and engaging with a second idler gear wheel 56.

During the rotation of the shaft 26, and therefore of the gear wheels 55 and 56, the oil collected in the body 5 is sucked into the housing 54, then compressed in the spaces arranged between the gear wheels and the body 5, before being carried away in the duct 52. Then, the compressed oil flows into the annular groove 51 to be finally taken into the return duct 37 with the aid of the duct 50.

As it goes without saying, the invention is not limited solely to the embodiments of this compressor described above as examples; on the contrary, it covers all the variant embodiments. Therefore, in particular, the end of the return duct turned toward the compression stage could be blocked off for specific requirements of use. In addition, the coupling 12 could open into the annular volume 13 in the bottom portion of the motor.

In addition, this arrangement could be associated with compressor structures different from those described, particularly with compressors having different gas circuits without for all that departing from the context of the invention.

The invention claimed is:

1. A cooling spiral compressor, comprising:

a sealed enclosure containing a suction volume and a compression volume placed respectively on the side of the two ends of the enclosure on either side of a body, the enclosure comprising a refrigerant gas inlet, an electric motor placed on the suction side having a stator and a rotor fixedly attached to a drive shaft in the form of a crankshaft, the drive shaft comprising an out-of-alignment lubrication duct extending over the whole length of the drive shaft, supplied by oil contained in a casing situated in the bottom portion of the enclosure by an oil pump placed at a first end of the shaft, the lubrication duct comprising lubrication orifices at different guide bearings of the shaft, the second end of the drive shaft being fitted with a device for driving the movable spiral of the compressor in an orbital motion, wherein the drive shaft comprises a return duct parallel or inclined relative to the axis of the shaft and extending over at least a portion of the length of the shaft, one of the ends of the return duct opening into the wall of the shaft, in the zone of the shaft situated beyond the rotor, on the side of the oil casing, means being provided for placing the lubrication and return ducts in fluidic communication.

2. The compressor as claimed in claim 1, wherein the second end of the return duct opens at the end of the shaft situated on the side of the movable spiral, the means for placing in fluidic communication comprising a space delimited by the end of the shaft situated on the side of the movable spiral and the bottom of a housing receiving this end of the shaft.

3. The compressor as claimed in claim 2, wherein the end of the return duct opening at the end of the shaft situated on the side of the movable spiral opens close to the center of the shaft.

4. The compressor as claimed in claim 1, wherein the means for placing in fluidic communication comprise at least one transverse orifice arranged in the shaft whose two ends open respectively into the lubrication and return ducts.

5. The compressor as claimed in claim 4, wherein the transverse orifice extends radially relative to the shaft.

6. The compressor as claimed in claim 1, wherein the end of the return duct opening, on the side of the casing, into the wall of the shaft is situated substantially at the second end of the shaft.

7. The compressor as claimed in claim 1, wherein the end of the return duct opening on the side of the casing comprises a vacuum pump designed to accelerate the flow of fluid in the return duct.

8. The compressor as claimed in claim 1, wherein the diameter of the return duct is less than or equal to the diameter of the lubrication duct.

9. The compressor as claimed in claim 1, wherein the lubrication duct is inclined relative to the axis of the shaft.

10. The compressor as claimed in claim 1, wherein the body of the compressor forms an oil collector designed to collect the leakage flows from the bearings situated on the side of the movable spiral, recirculation means being provided to move the oil collected by the collector in the return duct.

11. The compressor as claimed in claim 10, wherein the recirculation means comprise a duct arranged in the drive shaft opening on the one hand into the return duct and on the other hand into an annular groove arranged in the shaft or in the body of the compressor, a duct supplied with oil from the collector by an oil pump opening into the annular groove.

* * * * *